US007201472B2

(12) United States Patent
Silverbrook

(10) Patent No.: US 7,201,472 B2
(45) **Date of Patent: *Apr. 10, 2007**

(54) INKJET NOZZLE HAVING FLUIDIC SEAL BETWEEN INK EJECTION MEMBER AND STATIONARY MEMBER

(75) Inventor: Kia Silverbrook, Balmain (AU)

(73) Assignee: Silverbrook Research Pty Ltd, Balmain, NSW (AU)

( * ) Notice: Subject to any disclaimer, the term of this patent is extended or adjusted under 35 U.S.C. 154(b) by 0 days.

This patent is subject to a terminal disclaimer.

(21) Appl. No.: 11/478,587

(22) Filed: Jul. 3, 2006

(65) Prior Publication Data

US 2006/0244785 A1 Nov. 2, 2006

Related U.S. Application Data

(63) Continuation of application No. 11/144,758, filed on Jun. 6, 2005, which is a continuation of application No. 10/636,205, filed on Aug. 8, 2003, now Pat. No. 6,921,153, which is a continuation-in-part of application No. 09/575,152, filed on May 23, 2000, now Pat. No. 7,018,016.

(51) Int. Cl.
*B41J 2/04* (2006.01)
*B04J 2/05* (2006.01)

(52) U.S. Cl. ..... 347/54; 347/65

(58) Field of Classification Search ..... 347/20, 347/44, 47, 53, 56, 61–65, 67, 54; 60/527–529
See application file for complete search history.

(56) References Cited

U.S. PATENT DOCUMENTS

| | | | | |
|---|---|---|---|---|
| 5,184,147 | A | 2/1993 | MacLane et al. | 347/130 |
| 5,278,585 | A | 1/1994 | Karz et al. | 347/165 |
| 6,010,254 | A | 1/2000 | Sanada | 347/47 |
| 6,053,976 | A | 4/2000 | Takatsuka et al. | 118/314 |
| 6,338,548 | B1 | 1/2002 | Silverbrook | 347/165 |
| 6,536,874 | B1 | 3/2003 | Silverbrook | 347/54 |
| 6,641,256 | B1 | 11/2003 | Silverbrook | 347/54 |
| 6,921,153 | B2 * | 7/2005 | Silverbrook | 347/54 |

FOREIGN PATENT DOCUMENTS

| | | |
|---|---|---|
| JP | 07089097 A | 4/1995 |
| JP | 09174875 A | 7/1997 |
| JP | 09254410 A | 9/1997 |
| WO | WO 99/03680 A | 1/1999 |
| WO | WO 99/03681 A | 1/1999 |

* cited by examiner

*Primary Examiner*—Juanita D. Stephens

(57) ABSTRACT

An inkjet nozzle is provided. The nozzle comprises: a nozzle chamber having an ink ejection aperture defined therein; a stationary member; and an ink ejection member for ejecting ink from the aperture. The ink ejection member is moveable relative to the stationary member. Further, the ink ejection member and the stationary member are configured such that a sealing meniscus is formed therebetween. The meniscus maintains a fluidic seal during ink ejection.

5 Claims, 6 Drawing Sheets

INKJET NOZZLE HAVING FLUIDIC SEAL BETWEEN INK EJECTION MEMBER AND STATIONARY MEMBER

CROSS-REFERENCES TO RELATED APPLICATIONS

This is a Continuation Application of U.S. application Ser. No. 11/144,758 filed on Jun. 6, 2005, which is a Continuation of U.S. application Ser. No. 10/636,205 filed on Aug. 8, 2003, now granted U.S. Pat. No. 6,921,153, which is a Continuation-In-Part of U.S. application Ser. No. 09/575,152 filed on May 23, 2000, now granted U.S. Pat. No. 7,018,016, all of which is herein incorporated by reference.

REFERENCED PATENT APPLICATIONS

This application is a continuation-in-part application of U.S. application Ser. No. 09/575,152. The following applications and patents are hereby incorporated by reference:

| | | | | | |
|---|---|---|---|---|---|
| 6428133 | 6526658 | 6315399 | 6338548 | 6540319 | 6328431 |
| 6328425 | 6991320 | 6383833 | 6464332 | 6390591 | 7018016 |
| 6328417 | 6322194 | 6382779 | 6629745 | 09/575197 | 7079712 |
| 09/575123 | 6825945 | 09/575165 | 6813039 | 6987506 | 7038797 |
| 6980318 | 6816274 | 7102772 | 09/575186 | 6681045 | 6728000 |
| 09/575145 | 7088459 | 09/575181 | 7068382 | 7062651 | 6789194 |
| 6789191 | 6644642 | 6502614 | 6622999 | 6669385 | 6549935 |
| 6987573 | 6727996 | 6591884 | 6439706 | 6760119 | 09/575198 |
| 6290349 | 6428155 | 6785016 | 6870966 | 6822639 | 6737591 |
| 7055739 | 09/575129 | 6830196 | 6832717 | 6957768 | 09/575162 |
| 09/575172 | 09/575170 | 7106888 | 09/575161 | 6409323 | 6281912 |
| 6604810 | 6318920 | 6488422 | 6795215 | 09/575109 | 6924907 |
| 6712452 | 6416160 | 6238043 | 6958826 | 6812972 | 6553459 |
| 6967741 | 6956669 | 6903766 | 6804026 | 09/575120 | 6975429 |
| 6485123 | 6425657 | 6488358 | 7021746 | 6712986 | 6981757 |
| 6505912 | 6439694 | 6364461 | 6378990 | 6425658 | 6488361 |
| 6814429 | 6471336 | 6457813 | 6540331 | 6454396 | 6464325 |
| 6443559 | 6435664 | 6488360 | 6550896 | 6439695 | 6447100 |
| 09/900160 | 6488359 | 6618117 | 6803989 | 7044589 | 6416154 |
| 6547364 | 6644771 | 6565181 | 6857719 | 6702417 | 6918654 |
| 6616271 | 6623108 | 6625874 | 6547368 | 6508546 | |

Some applications are temporarily identified by docket numbers. The docket numbers will be replaced by the corresponding U.S. Ser. No. when available.

STATEMENT REGARDING FEDERALLY SPONSORED RESEARCH OR DEVELOPMENT

Not Applicable

FIELD OF THE INVENTION

This invention relates to a fluidic sealing structure. More particularly, this invention relates to a liquid displacement assembly that incorporates a fluidic seal.

BACKGROUND OF THE INVENTION

As set out in the above referenced applications/patents, the Applicant has spent a substantial amount of time and effort in developing printheads that incorporate micro electromechanical system (MEMS)—based components to achieve the ejection of ink necessary for printing.

As a result of the Applicant's research and development, the Applicant has been able to develop printheads having one or more printhead chips that together incorporate up to 84 000 nozzle arrangements. The Applicant has also developed suitable processor technology that is capable of controlling operation of such printheads. In particular, the processor technology and the printheads are capable of cooperating to generate resolutions of 1600 dpi and higher in some cases. Examples of suitable processor technology are provided in the above referenced patent applications/patents.

The Applicant has overcome substantial difficulties in achieving the necessary ink flow and ink drop separation within the ink jet printheads.

Each of the nozzle arrangements of the printhead chip incorporates one or more moving components in order to achieve drop ejection. The moving components are provided in a number of various configurations.

Generally, each nozzle arrangement has a structure that at least partially defines a nozzle chamber. This structure can be active or static.

When the structure is active, the structure moves relative to a chip substrate to eject ink from an ink ejection port defined by the structure. In this configuration, the structure can define just a roof for the nozzle chamber or can define both the roof and sidewalls of the nozzle chamber. Further, in this configuration, a static ink ejection formation is provided. The active structure moves relative to this formation to reduce a volume of the nozzle chamber in order to achieve the necessary build up of ink pressure. The static formation can simply be walls defined by the substrate. In this case, the active structure is usually in the form of a roof that is displaceable into and out of the nozzle chamber to achieve the ejection of ink from the ink ejection port.

Instead, the static formation can extend into the nozzle chamber to define an ink ejection area that faces a direction of ink drop ejection. The active structure then includes sidewalls that move relative to the static formation when the active structure is displaced to eject ink.

It will be appreciated that some form of seal is required between the active structure and the static formation to inhibit ink from escaping from the nozzle chamber when the active structure is displaced towards the substrate and ink pressure is developed in the nozzle chamber.

When the structure defining the nozzle chamber is static, an ink ejection member is usually positioned in the nozzle chamber. The structure also has a roof with an ink ejection port defined in the roof. The ink ejection member is often connected to an actuator that extends through a wall of the structure. The ink ejection member is actuated by the actuator to be displaceable towards and away from the roof to eject ink from the ink ejection port.

It will be appreciated that a seal is required at a juncture between the actuator or ink ejection member and the wall.

Applicant has found that it is convenient to use a surface tension of the ink to set up a fluidic seal between the active and static components of the nozzle arrangements. The fluidic seal uses surface tension of the ink to set up a meniscus between the active and static components so that the meniscus can act as a suitable seal to inhibit the leakage of ink.

Cohesive forces between liquid molecules are responsible for the phenomenon known as surface tension. The molecules at the surface do not have other like molecules on all sides of them and consequently they cohere more strongly to those directly associated with them on the surface. This forms a surface "film" which makes it more difficult to move an object through the surface than to move it when it is completely submersed.

Surface tension is typically measured in dynes/cm, the force in dynes required to break a film of length 1 cm. Equivalently, it can be stated as surface energy in ergs per square centimeter. Water at 20° C. has a surface tension of 72.8 dynes/cm compared to 22.3 for ethyl alcohol and 465 for mercury.

As is also known, a liquid can also experience adhesive forces when the molecules adhere to a material other than the liquid. This causes such phenomena as capillary action.

Applicant has found that an effective fluidic seal can be achieved by utilizing the phenomena of surface tension and adhesion.

A particular difficulty that the Applicant has discovered and addressed in achieving such a fluidic seal is the problem associated with excessive adhesion or "wetting" when a meniscus is stretched to accommodate relative movement of the active and static components. In particular, wetting occurs when the relative movement overcomes surface tension and an edge of the meniscus moves across a surface, to which the meniscus is adhered. This results in a weakening of the meniscus due to the larger area of the meniscus and increases the likelihood of failure of the meniscus and subsequent leaking of ink.

The Applicant has conceived this invention in order to address these difficulties. Furthermore, the Applicant has obtained surprisingly effective fluidic seals when addressing these difficulties by developing sealing structures that support such fluidic seals.

SUMMARY OF THE INVENTION

According to a first aspect of the invention, there is provided a liquid displacement assembly which comprises a first displacement member;

a second displacement member, the first and second displacement members together defining a volume in which liquid is received, at least one of the first and second displacement members being movable with respect to the other to displace liquid from the volume; and a sealing formation positioned on each displacement member, the sealing formations being shaped so that a fluidic seal is interposed between the sealing formations when the liquid is received in the volume, each sealing formation having a liquid adhesion surface positioned between side surfaces of the sealing formation and directed towards a plane of reference oriented substantially orthogonally with respect to a direction of relative displacement of the sealing formations, the sealing formations being spaced from each other to define a region in which a meniscus can be formed so that opposed edges of the meniscus adhere to respective adhesion surfaces of the sealing formations and the sealing formations being shaped so that each liquid adhesion surface is interposed between the side surfaces of each respective sealing formation and the plane of reference.

According to a second aspect of the invention, there is provided a printhead chip for an ink jet printhead, the printhead chip including a substrate; and a plurality of nozzle arrangements positioned on the substrate, each nozzle arrangement comprising a static ink ejection member positioned on the substrate;

an active ink ejection member, the static and active ink ejection members together defining a nozzle chamber in which ink is received, and the active ink ejection member including a roof that defines an ink ejection port, the active ink ejection member being displaceable towards and away from the substrate to reduce and subsequently enlarge the nozzle chamber so that ink in ejected from the ink ejection port; and a sealing formation positioned on each ink ejection member, the sealing formations being shaped so that a fluidic seal is interposed between the sealing formations when ink is received in the nozzle chamber, each sealing formation having a liquid adhesion surface positioned between side surfaces of the sealing formation and directed towards a plane of reference oriented substantially orthogonally with respect to a direction of relative displacement of the sealing formations, the sealing formations being spaced from each other to define a region in which a meniscus can be formed so that opposed edges of the meniscus adhere to respective adhesion surfaces of the sealing formations, the sealing formations being shaped so that the liquid adhesion surfaces are interposed between the side surfaces and the plane of reference.

According to a third aspect of the invention, there is provided a printhead chip for an ink jet printhead, the printhead chip comprising a substrate; and a plurality of nozzle arrangements positioned on the substrate, each nozzle arrangement comprising sidewalls and a roof that are arranged on the substrate, the sidewalls and the roof defining a nozzle chamber with an ink ejection port defined in the roof;

an ink ejection member that is positioned in the nozzle chamber, the ink ejection member being displaceable towards and away from the roof to eject ink from the ink ejection port and the ink ejection member extending through the sidewalls to be connected to an actuator positioned outside of the nozzle chamber; and at least one sealing formation positioned on the ink ejection member and at least one complementary sealing formation positioned on at least one of the sidewalls and the roof, the sealing formations being shaped so that a fluidic seal is interposed between the, or each sealing formation and the, or each, complementary sealing formation when ink is received in the nozzle chamber, each sealing formation having a liquid adhesion surface positioned between side surfaces of the respective sealing formation and directed towards a plane of reference oriented substantially orthogonally with respect to a direction of relative displacement of the sealing formations, the sealing formations being spaced from each other to define a region in which a meniscus can be formed so that opposed edges of the meniscus adhere to respective adhesion surfaces of the sealing formations, the sealing formations being shaped so that the liquid adhesion surfaces are interposed between the respective side surfaces and the plane of reference.

The invention is now described, by way of example, with reference to the accompanying drawings. The following description is not intended to limit the broad scope of the above summary.

DETAILED DESCRIPTION OF THE INVENTION

Figure 1:
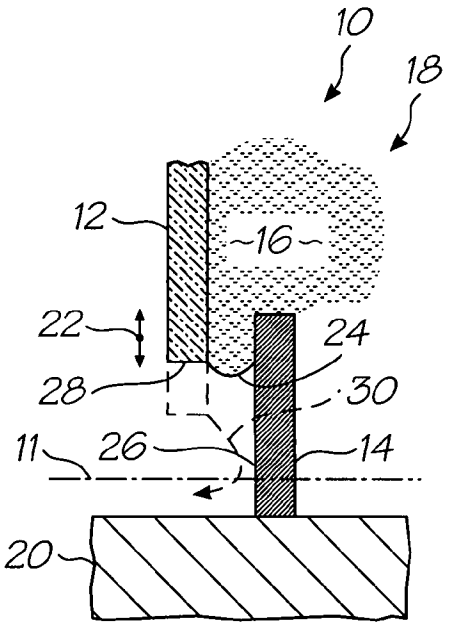
FIG. 1 shows a schematic side view of a pair of sealing formations to indicate a disadvantage associated with such a configuration.

This invention is directed towards the use of surface tension in order to provide a fluidic seal. Cohesive forces between liquid molecules are responsible for the phenomenon known as surface tension. Liquid molecules at a surface of a body of liquid do not have other like molecules on all sides of them and consequently they cohere more strongly to those directly associated with them on the surface. This forms a surface "film" which makes it more difficult to move an object through the surface than to move it when it is completely submersed. Surface tension is typically measured in dynes/cm, the force in dynes required to break a film of length 1 cm. Equivalently, it can be stated as surface energy in ergs per square centimeter. Water at 20° C. has a surface tension of 72.8 dynes/cm compared to 22.3 for ethyl alcohol and 465 for mercury.

Applicant has found that it is this surface tension is high enough in certain liquids to serve as a fluidic seal, provided that there are suitable formations to support a meniscus carrying the surface tension.

Surface tension plays a role in what is known as capillarity. This manifests itself when the liquid of the meniscus "wets" a surface supporting the meniscus. Wetting occurs when a contact angle defined between an edge of the meniscus and the surface reaches zero degrees. This wetting results in adhesive forces being set up between the liquid molecules and the molecules of the material defining the surface. When the adhesive forces are greater than the cohesive forces defining the surface tension, the edge of the meniscus is drawn along the surface, resulting in an increase in size of the meniscus. In water, for example, the adhesive forces between water molecules and the walls of a glass tube are stronger than the cohesive forces. Thus, the water can be drawn through such a tube against gravity, provided the tube is thin enough.

A fluidic seal is used when it is necessary to prevent liquid from escaping between components that move relative to each other. A particular advantage of a fluidic seal is that it uses the properties of the liquid to achieve sealing. It follows that the need for specialized sealing materials is obviated. However, it is important that displacement of edges of a meniscus defining the fluidic seal be constrained. This displacement can result in an increase in meniscus area. This increase also increases forces counteracting the surface tension, resulting in a breakdown of the meniscus and subsequent leaking. The Applicant has noted that movement of an edge of a meniscus can be substantially curtailed if the surface to which the edge is adhered is directed away from a direction of force exerted on the meniscus by such factors as gravity and liquid pressure.

In this description, a plane of reference, indicated by a reference line 11 is shown in the drawings. This is merely for ease of description. Furthermore, for the sake of convenience, the plane of reference is assumed to be horizontal, regardless of the fact that, as a whole, the various embodiments shown can be in any number of different orientations with respect to a true horizon. Still further, a direction towards the plane of reference 11 is assumed to be downward and a direction away from the plane of reference is assumed to be upward.

An example of an unsuitable sealing structure is indicated by reference numeral 10 in FIG. 1. The solid lines indicate the sealing structure 10 in a quiescent condition, while the dotted lines indicate the sealing structure 10 in an operative condition. In this example, a sidewall 12 of an active liquid displacement member moves vertically relative to a complementary sidewall 14 of a static liquid displacement member. The purpose for this displacement can be multifold. However, in this example, the purpose is for increasing and subsequently decreasing pressure of a liquid 16 positioned in a chamber, such as a nozzle chamber 18. The sidewall 12 is displaced towards and away from a substrate 20 as indicated by an arrow 22.

As can be seen, the complementary sidewall 14 has a vertically extending external surface 26. When the structure 10 is in a quiescent condition, a meniscus 24 is formed between a free edge 28 of the sidewall 12 and the external surface 26. When the structure 10 moves into the operative condition, a contact angle defined between the meniscus 24 and the external surface 26 reaches zero degrees, and the liquid 16 wets the external surface 26. As a result, the liquid 16 simply follows the external surface 26 towards the substrate 20 as shown by the dotted lines 30. The meniscus 24 then expands to an extent to which the cohesive forces are broken and the liquid 16 leaks from between the sidewalls 12, 14.

In FIGS. 2 to 6, there are shown various sealing structures that are suitable, to a greater or lesser extent, for inhibiting leakage of the liquid. All these structures form part of respective liquid displacement assemblies that fall within the scope of this invention. It is to be understood that the principles elucidated by these examples are applicable to a wide range of dimensions. The Applicant is presently involved in MEMS—based structures, and these examples are well suited to such structures. In the background to the invention it is set out that the Applicant has developed printhead technology in which up to 84 000 nozzle arrangements are incorporated into a single printhead. The printhead can include one or more printhead chips that span a print medium.

In accordance with this invention, each of the nozzle arrangements can include any of the sealing structures as shown in FIGS. 2 to 6. It follows that in this application, the sealing structures are on a microscopic scale, with sidewalls having a thickness of only a few microns. Further, a gap between the sidewalls is also only a few microns wide. It will be appreciated that such dimensions enhance the effects of surface tension. However, such small dimensions also enhance such phenomena as capillarity. It follows that the sealing structures should be dimensioned to inhibit excessive capillarity.

It is to be appreciated that, while the scale of the nozzle arrangements developed by the Applicant are microscopic, this invention finds application on the macroscopic scale as well. For example, with liquids and materials having certain characteristics, it is possible that the sidewalls and a gap between the sidewall could be visible by the naked eye. In other words, the sidewalls and the gap could have transverse dimensions that are measured in millimeters and large fractions of a millimeter.

It is to be noted that the orientation of the structures in FIGS. 1 to 6 is not intended to indicate their practical orientation in use. It follows that the effect of gravity should not be taken into account in these examples.

As set out in the background, the MEMS—based printhead is the product of an integrated circuit fabrication technique. Silicon dioxide is widely used in such techniques. As is known, silicon dioxide is simply an extremely pure glass. It follows that in this application, the sidewalls 12, 14 can be in the form of glass or a glass-like material. Furthermore, most inks are substantially water-based. It follows that interaction between the sidewalls 12, 14 and the liquid 16 can be similar to an interaction between glass and water.

Thus, in the structure 10, since the liquid 16 is water-like and the sidewalls 12, 14 are of a glass-like material, capillarity will manifest itself between the sidewalls 12, 14 and could draw the liquid 16 out between the sidewalls 12, 14 so that leakage occurs between the sidewalls 12, 14. This is especially so when the sidewall 12 is displaced relative to the sidewall 14.

Figure 2:
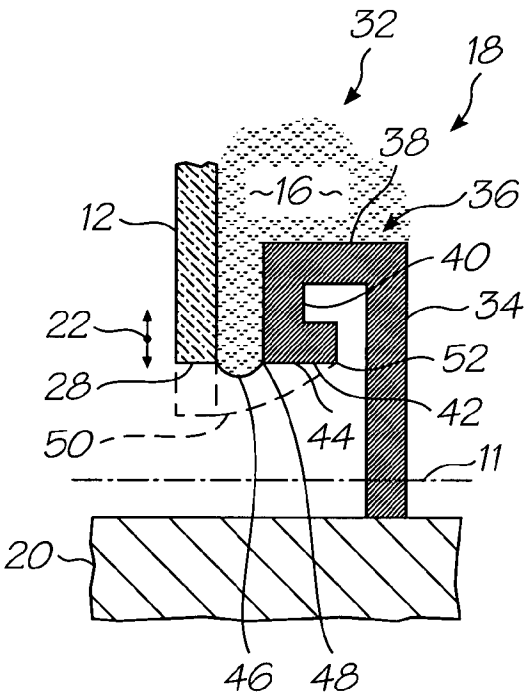
FIG. 2 shows a schematic side view of a pair of sealing formations of a first embodiment of a liquid displacement assembly, in accordance with the invention.

In FIG. 2, reference numeral 32 generally indicates a sealing structure, of a liquid displacement assembly, in accordance with the invention, that is suitable, under predetermined conditions, for setting up an effective fluidic seal to inhibit such leaking. With reference to FIG. 1, like reference numerals refer to like parts, unless otherwise specified.

The structure 32 has a complementary sidewall 34. A sealing formation 36 is positioned on the complementary sidewall 34. A first horizontal section 38, a second vertically downward section 40 and a third horizontal section 42 that extends towards the complementary sidewall 34 define the sealing formation 36. Thus, the sealing formation 36 has a re-entrant transverse profile.

In this example, the third horizontal section 42 defines a liquid adhesion surface 44. When the sealing structure 36 is in a quiescent condition, a meniscus 46 is formed between the free edge 28 of the sidewall 12 and an outer edge 48 of the liquid adhesion surface 44. As indicated by the dotted lines 50, when the sealing structure 36 moves into an operative condition, the meniscus 46 is positioned between the free edge 28 and an inner edge 52 of the liquid adhesion surface 44. Furthermore, since the surface 44 effectively turns upwardly and away from the plane of reference 11, the meniscus 46 is unable to extend past the inner edge 52. This serves to inhibit excessive enlarging of the meniscus 46 and subsequent leaking in the manner described above.

Figure 3:
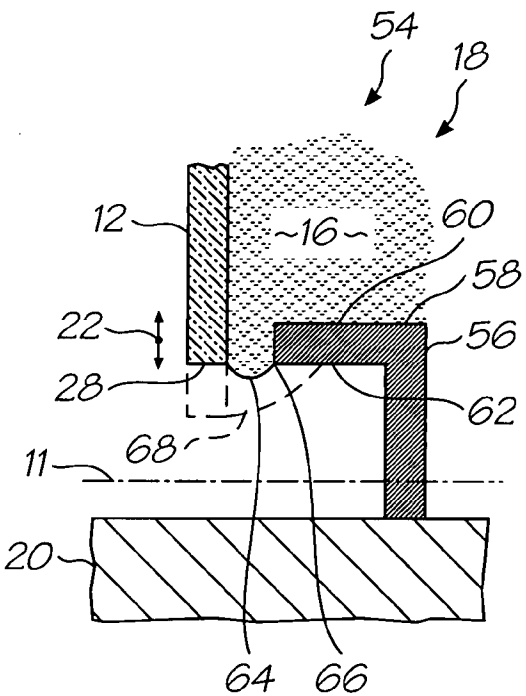
FIG. 3 shows a schematic side view of a pair of sealing formations of a second embodiment of a liquid displacement assembly, in accordance with the invention.

In FIG. 3, reference numeral 54 generally indicates a sealing structure, of a liquid displacement assembly, in accordance with the invention, that is also suitable, under certain conditions, for setting up a fluidic seal that inhibits such leaking. With reference to FIGS. 1 and 2, like reference numerals refer to like parts, unless otherwise specified.

The sealing structure 54 has a complementary sidewall 56. A sealing formation 58 is positioned on the complementary sidewall 56. The sealing formation 58 is in the form of an outwardly extending horizontal ledge 60. The ledge 60 defines a horizontal liquid adhesion surface 62.

When the structure 54 is in a quiescent condition, a meniscus 64 is defined between the free edge 28 of the sidewall 12 and an outer edge 66 of the liquid adhesion surface 62. When the structure 54 is in an operative condition, the meniscus 64 moves into the condition shown by dotted lines 68.

It will be appreciated that it is undesirable that the meniscus 64 reaches the complementary sidewall 56, since this will result in wetting of the complementary sidewall 56 and subsequent leakage. A simple force analysis reveals that whether the meniscus 64 does reach the complementary sidewall 56 depends on a contact angle that is defined between the meniscus 64 and the complementary sidewall 56. This contact angle increases as the sidewall 12 moves downwardly and is dependent on the extent of downward movement. It follows that the structure 54 is functional between certain ranges of movement of the sidewall 12.

Figure 4:
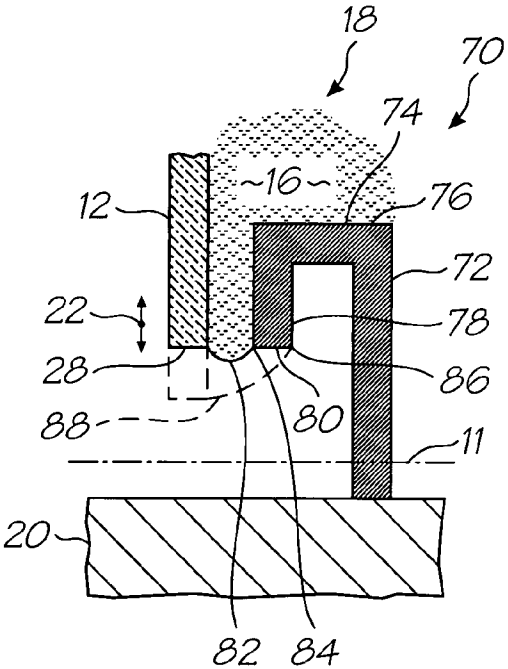
FIG. 4 shows a schematic side view of a pair of sealing formations of a third embodiment of a liquid displacement assembly, in accordance with the invention.

In FIG. 4, reference numeral 70 generally indicates a sealing structure, of a liquid displacement assembly, in accordance with the invention, that is suitable, under certain conditions, for setting up a fluidic seal that inhibits leaking. With reference to FIGS. 1 to 3, like reference numerals refer to like parts, unless otherwise specified.

The sealing structure 70 includes a complementary sidewall 72. A sealing formation 74 is positioned on the sidewall 72. The sealing formation 74 includes an outwardly and horizontally extending first section 76 and a downwardly extending vertical second section 78. The second section terminates facing the plane of reference 11. It follows that a free end of the sealing formation 74 defines a liquid adhesion surface 80. It also follows that the sealing formation 74 has a re-entrant profile.

In this example, a meniscus 82 extends from the free edge 28 of the sidewall 12 to an outer edge 84 of the liquid adhesion surface 80, when the structure is in a quiescent condition. In the operative condition, the meniscus 82 extends from the free edge 28 to an inner edge 86 of the surface 80 as indicated by dotted lines 88. In view of the preceding material, it will be appreciated that an extent of movement of the meniscus 82 is dependent on a thickness of the second section 78.

As set out above, in MEMS—based devices, such as the nozzle arrangement developed by the Applicant, the thickness of such a wall member is only a few microns. It is therefore extremely difficult to use such techniques to achieve a liquid adhesion surface that is much narrower than a few microns, using conventional integrated circuit fabrication techniques. Furthermore, the constraints on the extent of expansion of the meniscus 82 provided by the sealing structure 70 are sufficient to provide a workable fluidic seal.

Figure 5:
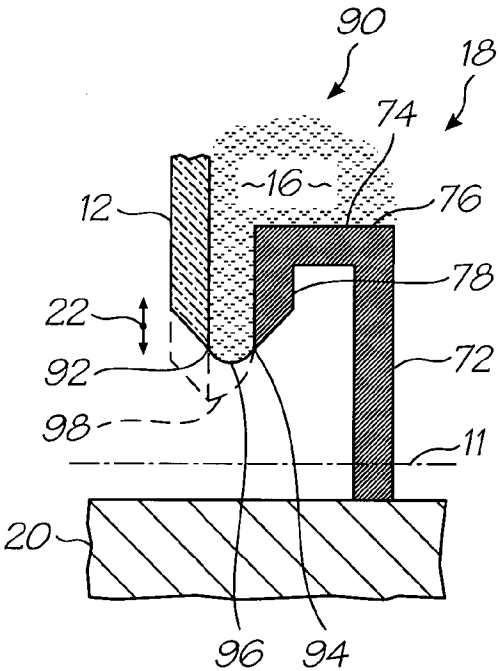
FIG. 5 shows a schematic side view of a pair of sealing formations of a fourth embodiment of a liquid displacement assembly, in accordance with the invention.

In FIG. 5, reference numeral 90 generally indicates an optimum sealing structure, of a liquid displacement assembly, in accordance with the invention. With reference to FIGS. 1 to 4, like reference numerals refer to like parts, unless otherwise specified.

The sealing structure 90 is substantially the same as the sealing structure 70, with the exception that a free end 92 of the sidewall 12 is tapered to define a vertex. A free end 94 of the second section 78 is also tapered to define a vertex.

In this optimum example, a meniscus 96 extends between the vertices 92, 94. It will thus be appreciated that a surface area of the meniscus 96 remains substantially unchanged as the structure 90 is displaced into its operative condition, as indicated by dotted lines 98. The reason for this is that the liquid adhesion surface defines by the vertices 92, 94 is dimensioned on a molecular scale, thereby providing practically no scope for movement of an edge of the meniscus 96.

While the structure 90 is optimum, it is extremely difficult to achieve the structure 90 with conventional integrated circuit fabrication techniques, as set out above. As is known, integrated circuit fabrication techniques involve deposition and subsequent etching of various layers of material. As such, tapered forms, such as those of the structure 90 are not practical and are extremely difficult and expensive to achieve.

Figure 6:
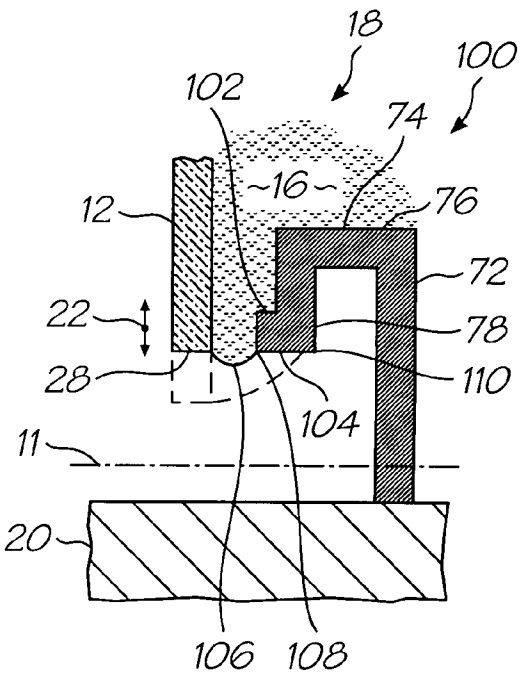
FIG. 6 shows a schematic side view of a pair of sealing formations of a fifth embodiment of a liquid displacement assembly, in accordance with the invention.

In FIG. 6, reference numeral 100 generally indicates a sealing structure, of a liquid displacement assembly, in accordance with the invention, that is suitable, under certain conditions, for setting up a fluidic seal. With reference to FIGS. 1 to 5, like reference numerals refer to like parts, unless otherwise specified.

The structure 100 is substantially the same as the structure 70. However, a lip 102 is positioned on the second section 78 so that the lip 102 and the free end of the second section 78 define a liquid adhesion surface 104. The lip 102 is a structural requirement that is determined by required alignment accuracy in a stepper process used in the fabrication of the sealing structure 100.

In this example, a meniscus 106 is set up between the free edge 28 of the sidewall 12 and an outer edge 108 of the lip 102 and the surface 104 when the structure is in a quiescent condition. The meniscus 106 extends from the free edge 28 of the sidewall 12 and an inner edge 110 of the surface 104.

The lip 102 does serve to increase the area of the surface 104 over the area of the surface 80. As set out above, this could be undesirable. However, the lip 102 is required for the stepper alignment process mentioned above and its exclusion could lead to fabrication errors that would outweigh any advantages that may be achieved by excluding the lip 102.

Figure 7:
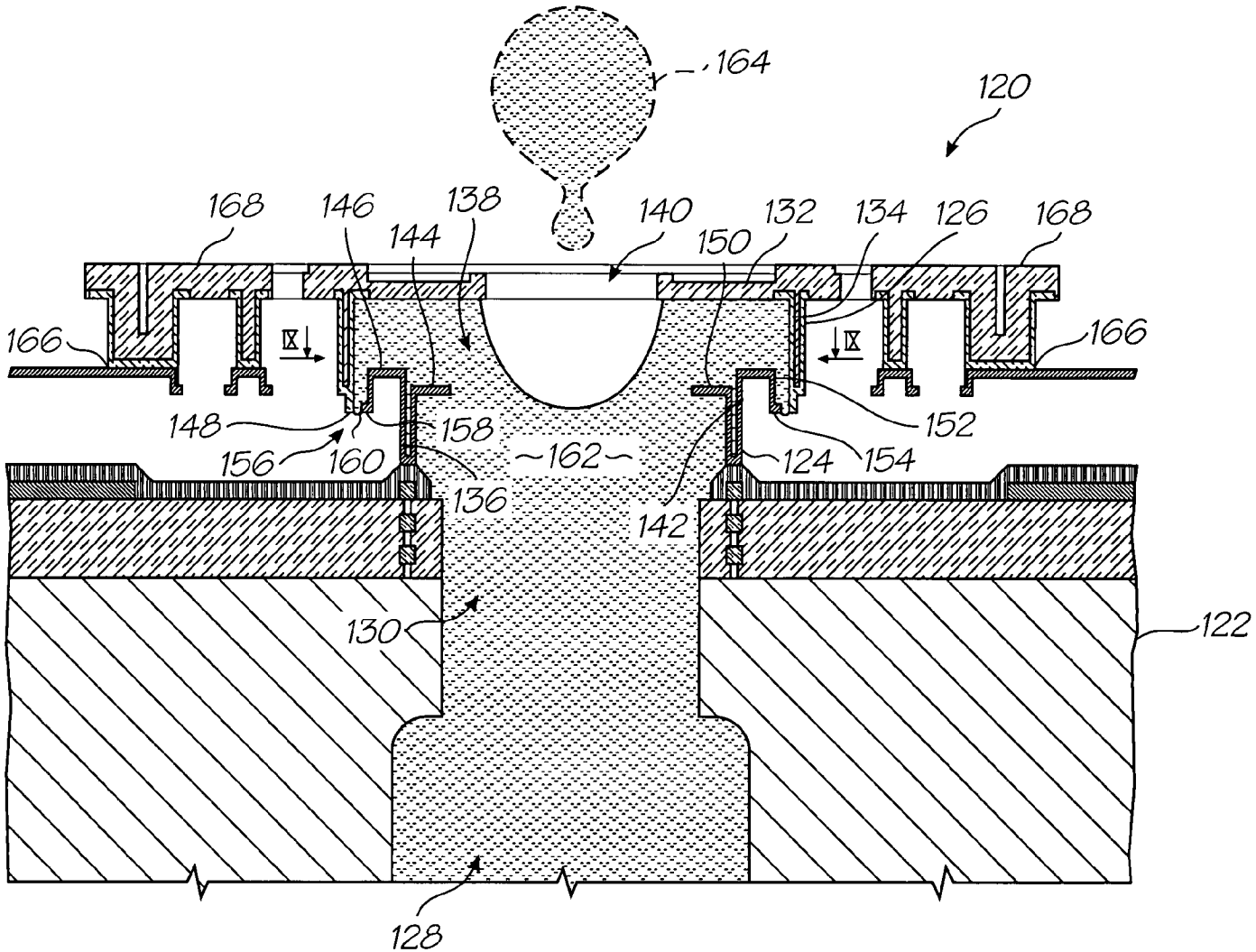
FIG. 7 shows a schematic sectioned side view of a nozzle arrangement of a first embodiment of a printhead chip, in accordance with the invention, in a quiescent condition.
Figure 8:
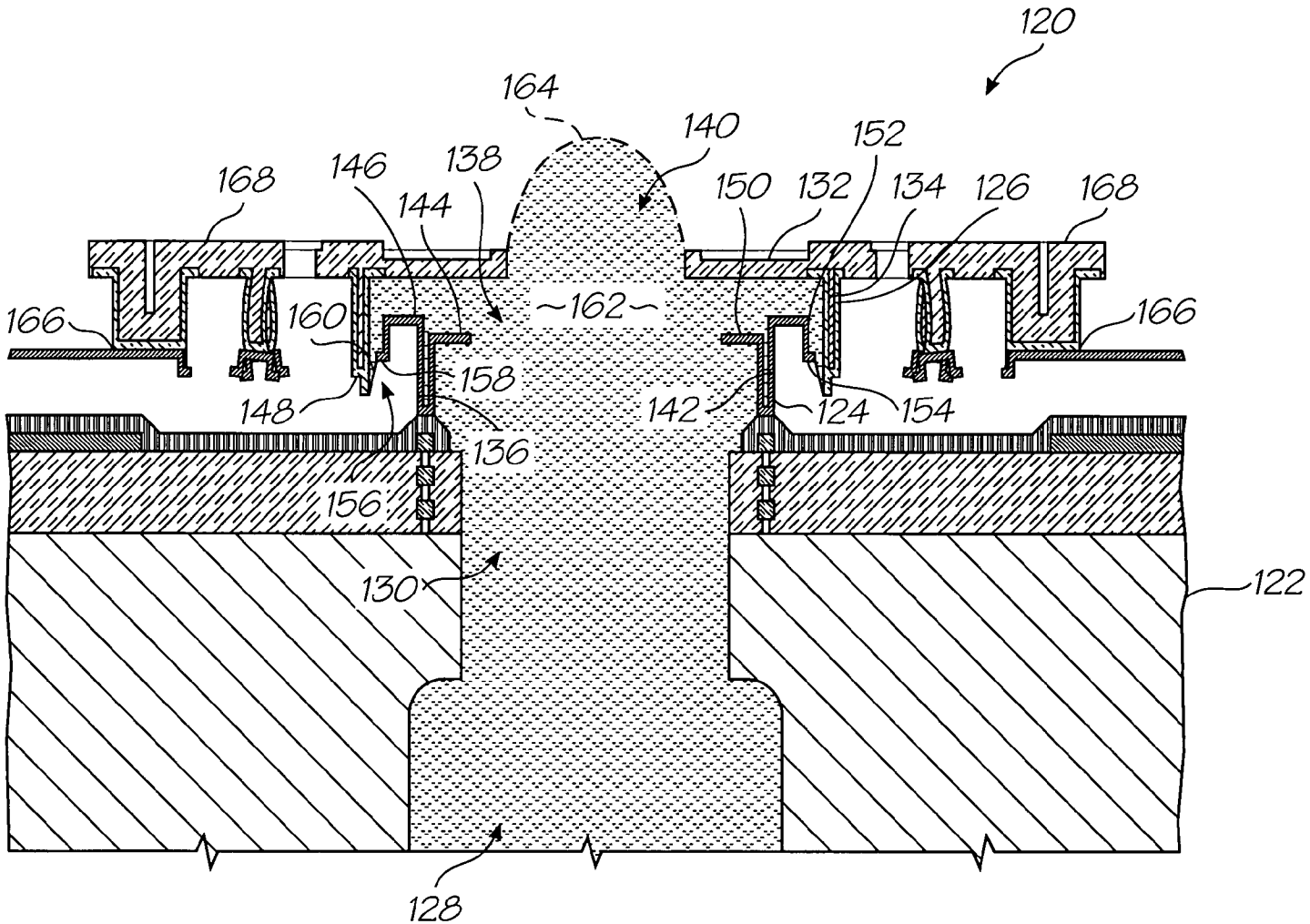
FIG. 8 shows a schematic sectioned side view of the nozzle arrangement of FIG. 7 in an operative condition.
Figure 9:
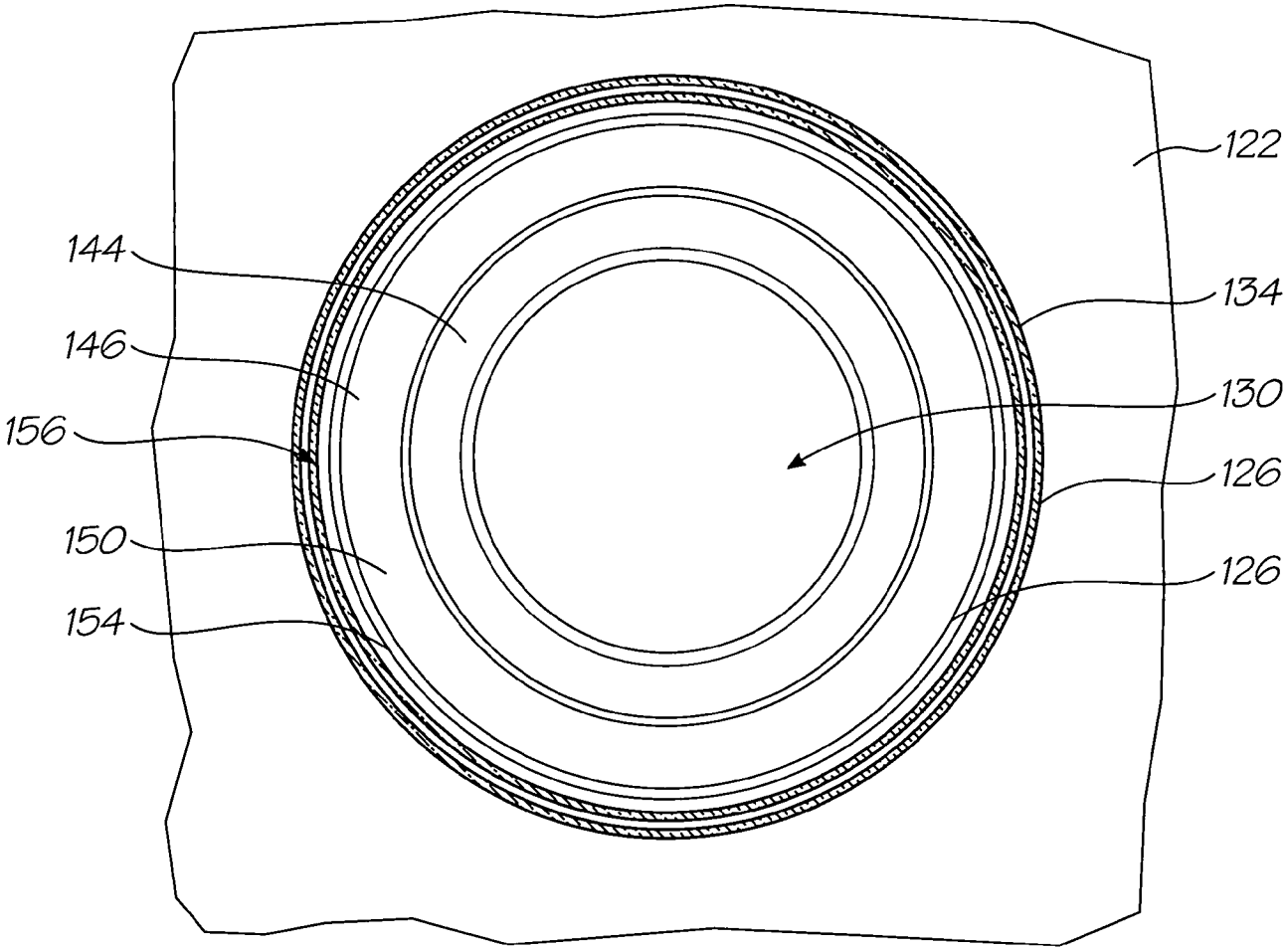
FIG. 9 shows a plan sectioned view of the nozzle arrangement of FIG. 7, taken through IX—IX in FIG. 7.

In FIGS. 7 and 8, reference numeral 120 generally indicates a nozzle arrangement of a first embodiment of a printhead chip, in accordance with the invention, for an ink jet printhead. With reference to FIGS. 1 to 6, like reference numerals refer to like parts, unless otherwise specified.

The nozzle arrangement 120 is one of a plurality of such nozzle arrangements positioned on a substrate 122 to define the printhead chip of the invention. As set out in the background, an ink jet printhead developed by the Applicant can include up to 84 000 such nozzle arrangements. It follows that it is for the purposes of convenience and ease of description that only one nozzle arrangement is shown. In integrated circuit fabrication techniques, it is usual practice to replicate a large number of identical components on a single substrate that is subsequently diced into separate components. It follows that the replication of the nozzle arrangement 120 to define the printhead chip should be readily understood by a reader of ordinary skill in the art.

In the description that follows the substrate 122 is to be understood to define the plane of reference 11 used in the preceding description. It follows that the same orientation naming conventions apply in the following description.

In FIG. 7, the nozzle arrangement 120 is shown in a quiescent condition and in FIG. 8, the nozzle arrangement 120 is shown in an operative condition.

An ink inlet channel 128 is defined through the substrate 122 to be in fluid communication with an ink inlet opening 130.

The nozzle arrangement 120 includes a static ink ejecting member 124 and an active ink ejecting member 126. The static ink ejecting member 124 has a wall portion 136 that is positioned on the substrate 122 to bound the ink inlet opening 130. The active ink ejecting member 126 includes a roof 132 and a sidewall 134 that depends from the roof 132 towards the substrate 122. The sidewall 134 is positioned outside of the wall portion 136, so that the sidewall 134 and the wall portion 136 define a nozzle chamber 138.

An ink ejection port 140 is defined in the roof 132 and is aligned with the ink inlet opening 130.

The wall portion 136 includes a sidewall 142 that extends from the substrate 122 towards the roof 132. A ledge 144 is positioned on the sidewall 142 and extends horizontally towards a position above the ink inlet opening 130. A sealing formation 146 is also positioned on the sidewall 142 and extends outwardly from the sidewall 142.

The sidewall 134 has a free end 148 that has a rectangular transverse profile. The sealing formation 146 has a horizontal first section 150 that extends from an upper end of the sidewall 142. A vertical second section 152 extends downwardly from an end of the first section 150. A lip 154 extends horizontally and outwardly from the second section 152. It follows that the sealing formation 146 is the same as the sealing formation 74 of the sealing structure 100 shown in FIG. 6. Further, the sidewall 134 is positioned relative to the sealing formation 146 so that the sidewall 134 and the sealing formation 146 define a sealing structure 156 that is substantially the same as the sealing structure 100. It follows that the lip 154 and the vertical second section 152 define an ink adhesion surface 158.

As can be seen in FIGS. 7 and 8, a meniscus 160 is formed between the free end 148 of the sidewall 134 and the ink adhesion surface 158 when the nozzle chamber 138 is filled with ink 162. Thus, a fluidic seal is set up between the sealing structure 156 and the sidewall 134. The operation and purpose of this fluidic seal has been fully described earlier in this description. As can be seen in the drawings, the roof 132 and sidewall 134 are displaced vertically downwardly towards the substrate so that an ink drop 164 is formed outside of the ink ejection port 140. During this displacement, an edge of the meniscus 160 moves from one side of the ink adhesion surface 158 to an opposed side to accommodate this movement. When the roof 132 and the sidewall 134 move back into the position shown in FIG. 7, the ink drop 164 separates from the remainder of the ink 162 in the nozzle chamber 138.

The sealing structure 156 and the ledge 144 have a vertically facing surface area that is sufficient to facilitate the ejection of ink, as described above, when the roof 132 is displaced towards the substrate 122.

The nozzle arrangement 120 includes a pair of symmetrically opposed thermal actuators 166 that act on the roof 132 to eject the ink drop 164. Each thermal actuator 166 is connected to suitable drive circuitry (not shown) arranged on the substrate 122. Details of the thermal actuators are set out in the above referenced applications and are therefore not set out in this description.

Each thermal actuator 166 is in the form of a bend actuator. It follows that a suitable connecting structure 168 is positioned intermediate each thermal actuator 166 and the roof 132. The connecting structures are configured to accommodate the different forms of movement of the roof 132 and the actuators 166. Further details of these connecting structures 168 are provided in the above referenced applications and are therefore not set out here.

Figure 10:
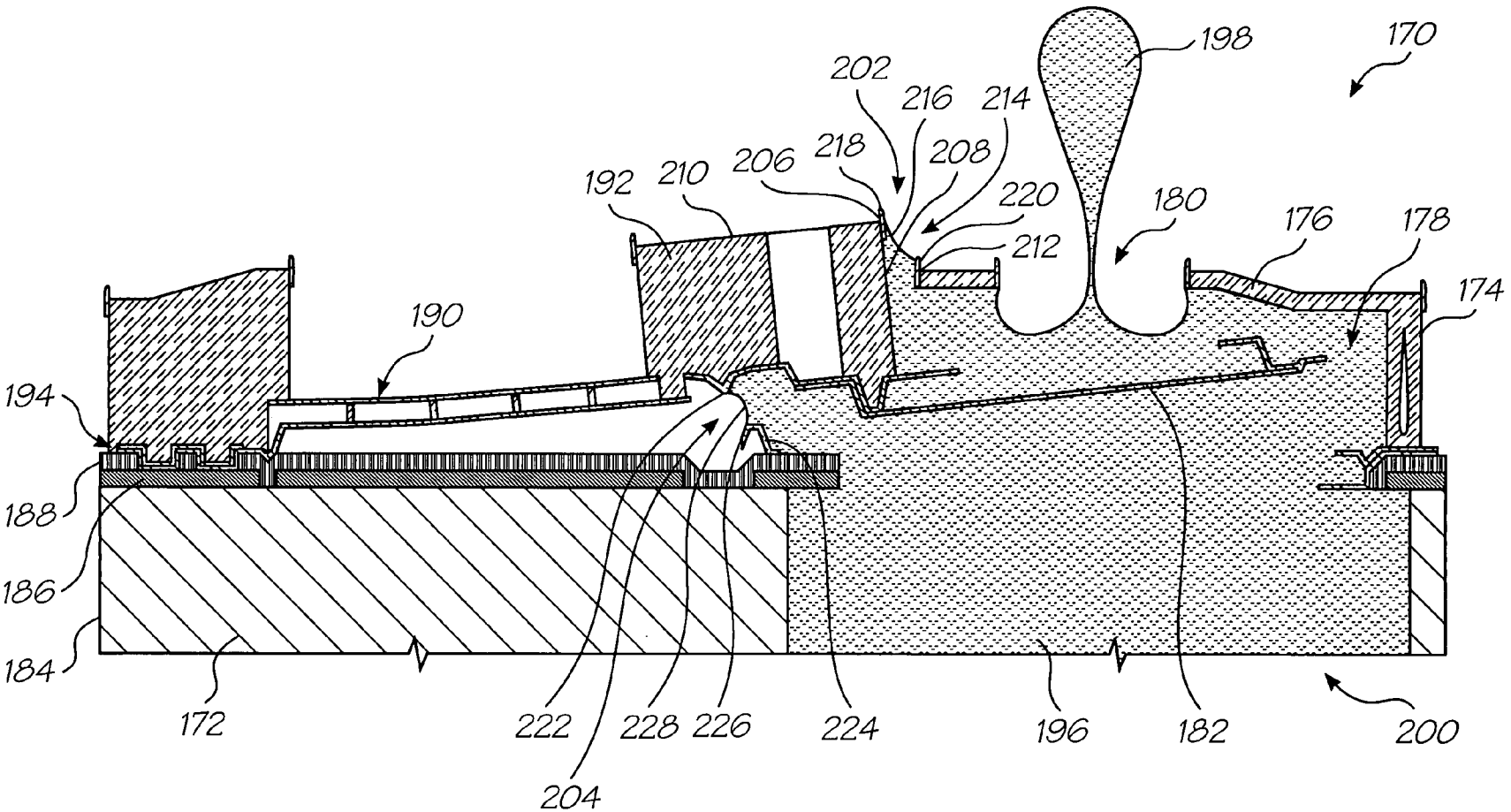
FIG. 10 shows a schematic sectioned side view of a nozzle arrangement of a second embodiment of a printhead chip, in accordance with the invention, in an operative condition.

In FIG. 10, reference numeral 170 generally indicates a nozzle arrangement of a second embodiment of a printhead chip, in accordance with the invention. With reference to FIGS. 1 to 9, like reference numerals refer to like parts, unless otherwise specified.

As with the nozzle arrangement 120, the nozzle arrangement 170 is one of a plurality of such nozzle arrangements set out on a substrate 172 to define the printhead chip of the invention. The reasoning behind this as been set out above and applies here as well. As with the previous embodiment, the substrate 172 is assumed, for the purposes of convenience, to define the plane of reference 11 referred to earlier in this description. Thus, the orientation terminology referred to earlier is used in the following description.

A sidewall 174 and a roof 176 are positioned on the substrate 172 to define a nozzle chamber 178. An ink ejection port 180 is defined in the roof 176.

The substrate 172 includes silicon wafer substrate 184, a CMOS layer 186 that defines drive circuitry for the nozzle arrangement 170 and an ink passivation layer 188 positioned on the CMOS layer 186.

An ink ejection member in the form of a paddle 182 is positioned in the nozzle chamber 178. The paddle 182 is connected to a thermal bend actuator 190 with a connecting member 192 interposed between the paddle 182 and the thermal bend actuator 190.

The thermal bend actuator 190 is connected to the CMOS layer 186 with suitable vias 194 so that the thermal bend actuator 190 can be driven by the drive circuitry. The thermal bend actuator 190 and its operation are fully described in the above referenced applications and these details are therefore not set out here. The thermal bend actuator 190 serves to displace the paddle 182 through an arc towards and away from the ink ejection port 180. In FIG. 10, the nozzle arrangement 170 is shown in an operative position with the paddle 182 displaced towards the ink ejection port 180 so that ink 196 within the nozzle chamber 178 is ejected from the ink ejection port 180 to form a drop 198. The drop 198 separates from the ink 196 when the paddle 182 returns to a quiescent condition and ink pressure in the nozzle chamber 178 drops. The nozzle chamber 178 is in fluid communication with an ink inlet channel 200 defined in the substrate 172, so that the nozzle chamber 178 can be refilled with ink once the drop 198 has been ejected. This occurs when the pressure drop mentioned above is equalized.

The connecting member 192 and roof 176 define an upper sealing structure 202. The connecting member 192 and the sidewall 174 define a lower sealing structure 204.

The upper sealing structure 202 includes a sealing formation in the form of an outer, elongate plate 206 positioned on an inner side 208 of the connecting member 192 adjacent an upper surface 210 of the connecting member 192. When the nozzle arrangement 170 is in a quiescent condition, the plate 206 is positioned in a vertical plane.

The upper sealing structure 202 includes a further sealing formation in the form of an inner, elongate plate 212 that is positioned on the roof 176. The inner elongate plate 212 is horizontally aligned with the outer plate 206, when the nozzle arrangement 170 is in a quiescent condition. Further, a gap 214 defined between the plates 206, 212 is such that a meniscus 216 is formed between the plates 206, 212, the meniscus 216 extending between upper edges 218, 220 of the plates 206, 212, respectively.

The edges 218, 220 are proud of the surface 210 and the roof 176, respectively. Thus, an extent of movement of edges of the meniscus 216 is determined by a thickness of the plates 206, 212. It follows that when the paddle 182 is displaced towards and away from the ink ejection port 180, as described above, the meniscus 216 defines a fluidic seal to inhibit leaking of the ink 196. As set out above, the reason behind this is that a contact angle of the meniscus 216 with the plates 206, 212 does not reach zero degrees during movement of the connecting member 192 relative to the roof 176.

The lower sealing structure 204 includes a lower sealing formation in the form of a downward projection 222 defined by the connecting member 192. The sidewall 174 defines a sealing formation in the form of a re-entrant wall portion 224 positioned on the substrate 172. The re-entrant wall portion 224 includes an outer rim 226 that is horizontally aligned with the downward projection 222 when the nozzle arrangement 170 is in a quiescent condition. A meniscus 228 extends between the downward projection 222 and the outer rim 226 when the nozzle chamber 178 is filled with the ink 196.

As is clear from the drawings, the sealing structure 204 is similar in form to the sealing structures 70 and 90 shown in FIGS. 4 and 5 respectively. The operation and advantages of the sealing structure 204 are therefore clear and need not be described at this stage. It follows that the meniscus 228 defines a suitable fluidic seal that inhibits the leaking of ink during operation of the nozzle arrangement 170.

The invention claimed is:

1. An inkjet nozzle comprising:

a nozzle chamber having an ink ejection aperture defined therein;

a stationary member; and an ink ejection member for ejecting ink from said aperture, said ink ejection member being moveable relative to said stationary member, wherein said ink ejection member and said stationary member are configured such that a sealing meniscus is formed therebetween, and said meniscus maintains a fluidic seal during ink ejection.

2. The inkjet nozzle of claim 1, wherein said ink ejection member and said stationary member each comprise respective complementary sealing formations, said sealing formations cooperating to form said sealing meniscus therebetween and to maintain the fluidic seal during ink ejection.

3. The inkjet nozzle of claim 2, wherein at least one sealing formation comprises a vertex and said meniscus pins against said vertex.

4. The inkjet nozzle of claim 2, wherein each sealing formation comprises a respective vertex and said meniscus pins between said respective vertices.

5. An inkjet printhead comprising a plurality of nozzles, each nozzle comprising:

a nozzle chamber having an ink ejection aperture defined therein;

a stationary member; and an ink ejection member for ejecting ink from said aperture, said ink ejection member being moveable relative to said stationary member, wherein said ink ejection member and said stationary member are configured such that a sealing meniscus is formed therebetween, and said meniscus maintains a fluidic seal during ink ejection.

* * * * *